US008348787B2

(12) United States Patent
Halsey et al.

(10) Patent No.: US 8,348,787 B2
(45) Date of Patent: Jan. 8, 2013

(54) MULTIPURPOSE GOLF DIVOT TOOL

(76) Inventors: Jay Halsey, Norco, CA (US); Dean Sexton, Costa Mesa, CA (US)

( * ) Notice: Subject to any disclaimer, the term of this patent is extended or adjusted under 35 U.S.C. 154(b) by 196 days.

(21) Appl. No.: 12/487,493

(22) Filed: Jun. 18, 2009

(65) Prior Publication Data

US 2010/0323823 A1 Dec. 23, 2010

(51) Int. Cl.
*A63B 57/00* (2006.01)

(52) U.S. Cl. ..... 473/408; 431/253

(58) Field of Classification Search ..... 473/408, 473/286; D21/793; D27/141–143, 148; 431/129

See application file for complete search history.

(56) References Cited

U.S. PATENT DOCUMENTS

| | | | | | |
|---|---|---|---|---|---|
| D170,767 | S | * | 11/1953 | Polk | D27/142 |
| 3,539,017 | A | * | 11/1970 | Johnson | 473/408 |
| 3,622,157 | A | * | 11/1971 | Hatch | 473/406 |
| 4,151,937 | A | * | 5/1979 | Jarosh et al. | 224/666 |
| 4,960,239 | A | * | 10/1990 | Wait | 473/406 |
| 5,054,777 | A | * | 10/1991 | Borden et al. | 473/406 |
| D385,940 | S | * | 11/1997 | Justice | D21/794 |
| 6,022,211 | A | * | 2/2000 | Wang | 431/144 |
| 6,030,298 | A | * | 2/2000 | Tate | 473/408 |
| 6,050,905 | A | * | 4/2000 | Tate | 473/408 |
| D435,141 | S | * | 12/2000 | Reynolds | D27/142 |
| D435,691 | S | * | 12/2000 | Reynolds | D27/143 |
| 6,186,774 | B1 | * | 2/2001 | Butera, Jr. | 431/277 |
| D458,409 | S | * | 6/2002 | Najar et al. | D27/165 |
| D460,211 | S | * | 7/2002 | Park | D27/143 |
| 6,413,173 | B1 | * | 7/2002 | Muller et al. | 473/408 |
| D464,168 | S | * | 10/2002 | Reynolds et al. | D27/142 |
| 6,656,062 | B2 | * | 12/2003 | Vochezer | 473/408 |
| 6,837,807 | B1 | * | 1/2005 | Kerr | 473/408 |
| D508,295 | S | * | 8/2005 | Tadych et al. | D27/183 |
| D509,318 | S | * | 9/2005 | Poinstingl et al. | D27/143 |
| 7,083,535 | B1 | * | 8/2006 | Robinson | 473/408 |
| 2003/0032505 | A1 | * | 2/2003 | Christensen | 473/408 |
| 2008/0131826 | A1 | * | 6/2008 | Xie | 431/131 |
| 2011/0300495 | A1 | * | 12/2011 | Viviano | 431/253 |

OTHER PUBLICATIONS

BC Specialties, Cigar Golf Accessories, "Colibri ATL Golf Lighter", http://www.bcspecialties.com/cigarasp/golface.asp, Aug. 22, 2003.*

* cited by examiner

*Primary Examiner* — Steven Wong
(74) *Attorney, Agent, or Firm* — James A. Italia; Italia IP

(57) ABSTRACT

A golf tool having a plastic body with a two prong divot repair tool that protrudes from a first end of the body for repairing golf course divots. Located within the body is an integrated lighting device or, in the alternative, a waterproof empty chamber adapted to receive a lighting device or any item that can fit within the empty chamber.

13 Claims, 4 Drawing Sheets

MULTIPURPOSE GOLF DIVOT TOOL

BACKGROUND

This invention relates generally to a multipurpose tool which functions as a divot repair device as well as a carrying case for a lighter, matches, or any such small loose item, i.e. pocket change, a ring, a car key, etc. The device can also be structured wholly from a lighter.

SUMMARY

Divot tools are well known in the art and are used to repair a variety of aberrations created on a putting surface. Described herein is a multipurpose golf divot tool that combines the common functionality of a pronged divot tool with additional features in a novel way.

The multipurpose golf divot tool has a plastic body with a two prong divot repair tool that protrudes from a first end of the body for repairing golf course divots. Located within the body is an integrated lighting device or, in the alternative, a waterproof empty chamber adapted to receive a lighting device or any item that can fit within the empty chamber.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings wherein similar parts are designated with similar reference numerals.

DETAILED DESCRIPTION

Figure 1:
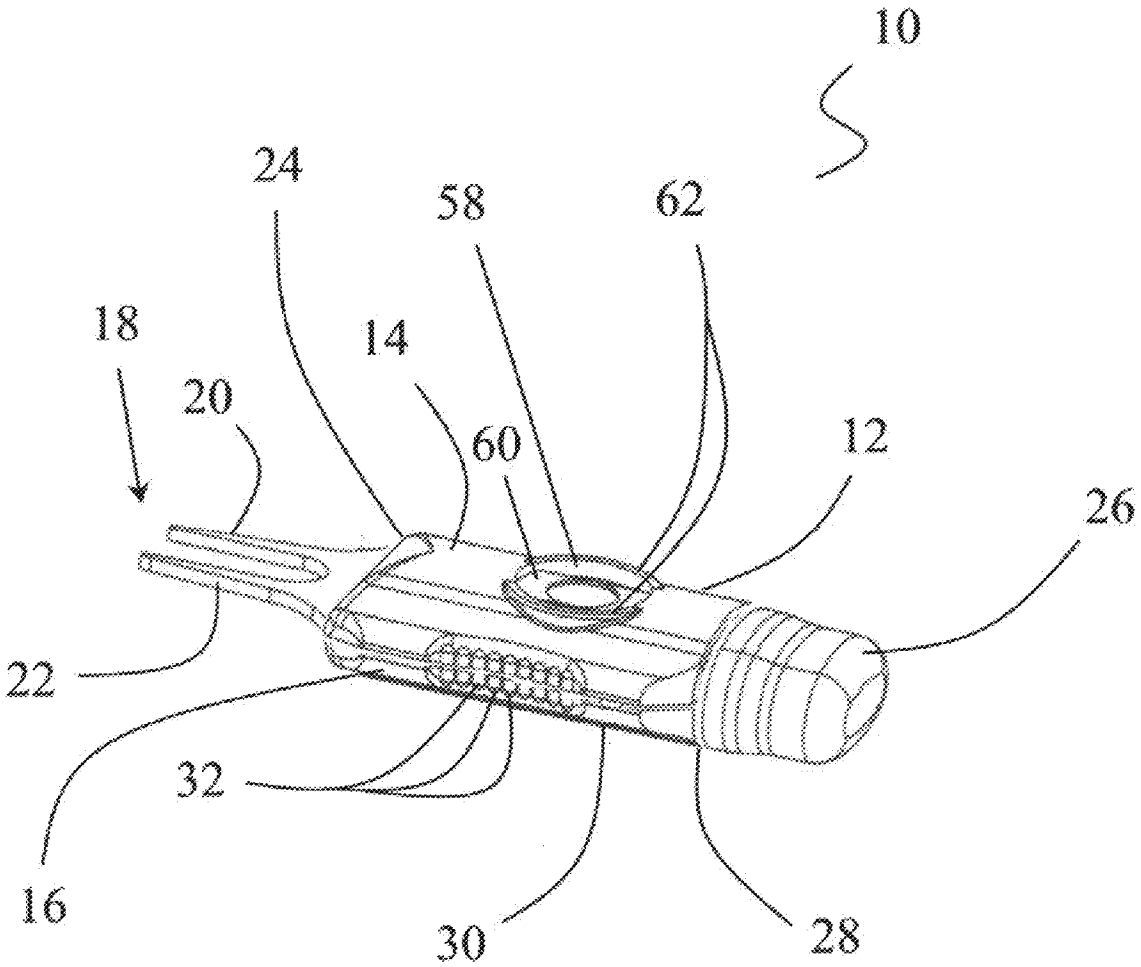
FIG. 1 is a perspective view of a golf divot tool in accordance with the principles of the invention.

Referring to FIG. 1, there is shown a perspective view of the multipurpose golf divot tool 10. The tool includes a body 12 that can be a single seamless member or have two side members formed by a first half member 14 and a second half member 16 composed of high quality durable rigid or semi-rigid plastic, aluminum or any other suitable material. A divot repair tool 18 having two prongs 20, 22 protrude from the lower end 24 of the body 12, a ball marker 58 is located within a pocket 60 defined by two semi-circular ridges 62 and is substantially mid-way between the top and bottom ends of the body 12 in the first member 14, and a cap 26 removably attached to the upper end 28 of the body 12.

Each side of the body 12 is configured to have a concave grip area 30 with ridges 32 that allows a user to handle and grip the tool while repairing a divot.

Figure 2:
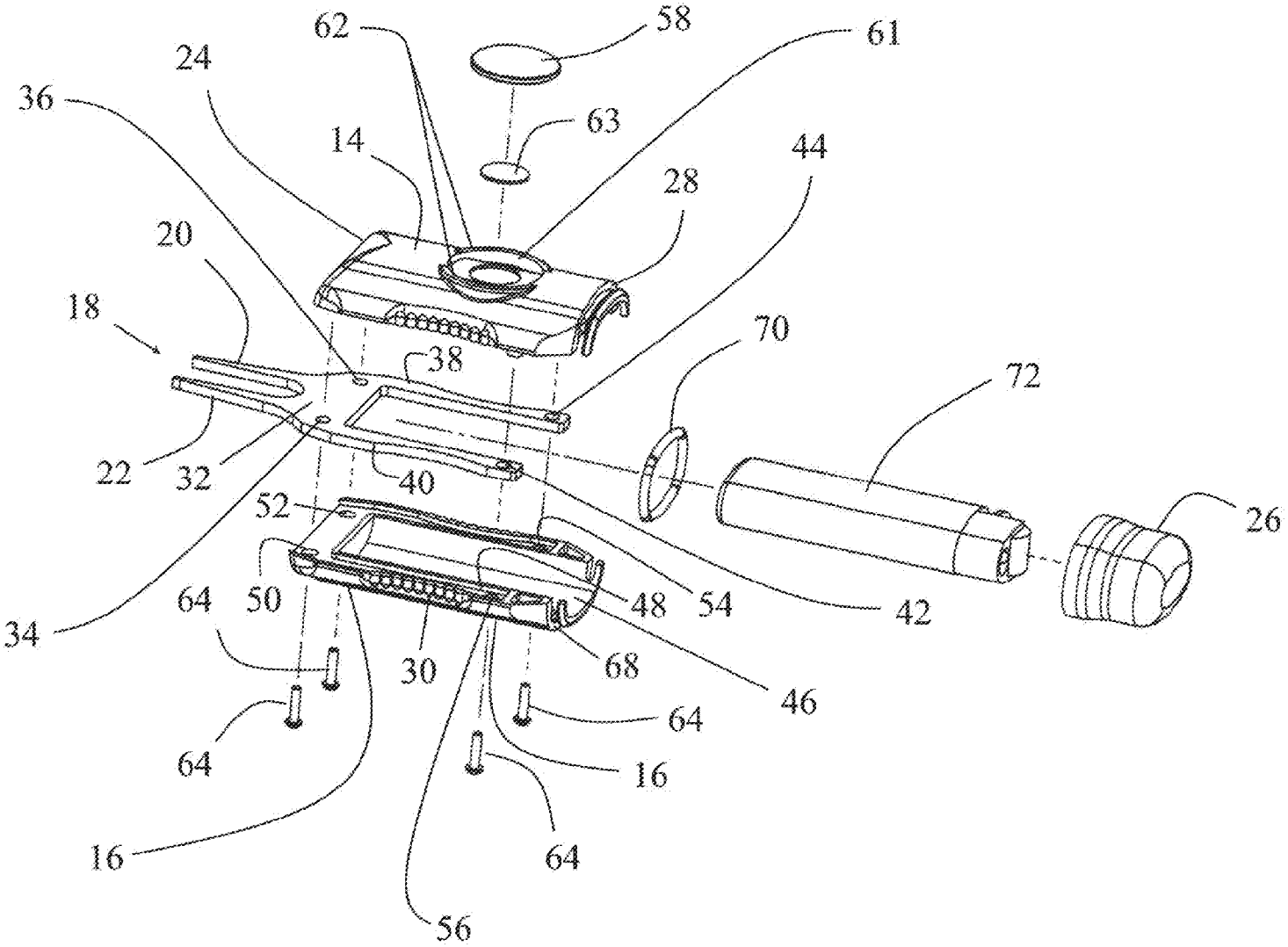
FIG. 2 is an exploded perspective view of the golf divot tool showing a lighting device such as a replaceable lighter in the tool.

Looking at FIG. 2, there is shown an exploded perspective view of the multi-purpose golf divot tool showing a lighting device positioned inside the tool Divot repair tool 18 includes two prongs 20, 22 that are attached to and project out from a central body 32 that has two clearance openings 34, 36. Two support arms 38, 40 that are attached to and project out from the opposite end of central body 32 have clearance openings 42, 44 at their ends. Divot repair tool 18 can be of stainless steel, brass, bronze, high quality plastic, etc., that resists breaking.

The second member 16 includes a central chamber 46 located between a U shaped channel 48 adapted to receive a portion of central body 32 and support arms 38, 40 where clearance openings 34, 36 in the central body are aligned with clearance openings 50, 52 in member 16 and clearance openings 42, 44 in the support arms 38, 40 are aligned with clearance openings 54, 56 in member 16. The upper end of member 16 has a channel 68 adapted to receive an O ring 70.

Referring to the second member 14, clearance openings 50, 52, and 54, 56 correspond to and are aligned with threaded openings in the first member when the first member is placed on top of the second member. Except for the presence of the removable ball marker pocket and the threaded openings, the interior of the first member 14 is substantially similar to the interior of the second member 16. Pocket 61 that is defined by two semi-circular ridges 62 on first member 14 supports a disk shaped magnet 63 located in pocket 60. The magnetic disk is secured with an adhesive such as an epoxy or the like to the side wall of the pocket. Removable ball marker 58 is composed of magnetic material such as iron and has a diameter that is slightly less than the diameter of the pocket defined by the two semi-circular ridges.

To assemble, support arms 38, 40 are placed into the U shaped channel 48 in the second member with the clearance openings in support arms 38, 40 being aligned with clearance openings 50, 52, 56, 58 in the second member. The first member is now placed on top of the first member and the divot repair tool and four threaded fasteners 64 are inserted thru the clearance openings in the second member, the clearance openings in the central body and the clearance openings in the support arms, and are threaded into the aligned threaded openings in the first member. O ring 70 is now placed into channel 68 of the assembled device. The O ring helps to secure the cap in place on the end 28 of the body 12.

The chamber in the assembled divot repair tool is waterproof and is sized to receive a lighting device. Since the chamber is waterproof, it is intended to be used to hold any item of the user's choice such as a bundle of wooden matches, a refillable lighter, a replaceable lighter, paper money, pocket change, a ring, car key, paper receipt, etc.

It is understood that the term lighting device, as used herein, refers to a match, a refillable lighter, a replaceable lighter or any device that can be used to ignite a flammable substance.

When a lighting device such as a refillable or replaceable lighter 72 is integrated with the divot repair tool, the igniter end of the lighting device will protrude beyond the end 28 of the divot repair tool body. Thus, the lighting device can be used without being removed from the divot repair tool. The protruding igniter end of the lighting device is covered when the cap is placed on the end of the body. Rubber O ring 70 helps to keep the lighting device within the body and the cap on the body.

Figure 3:
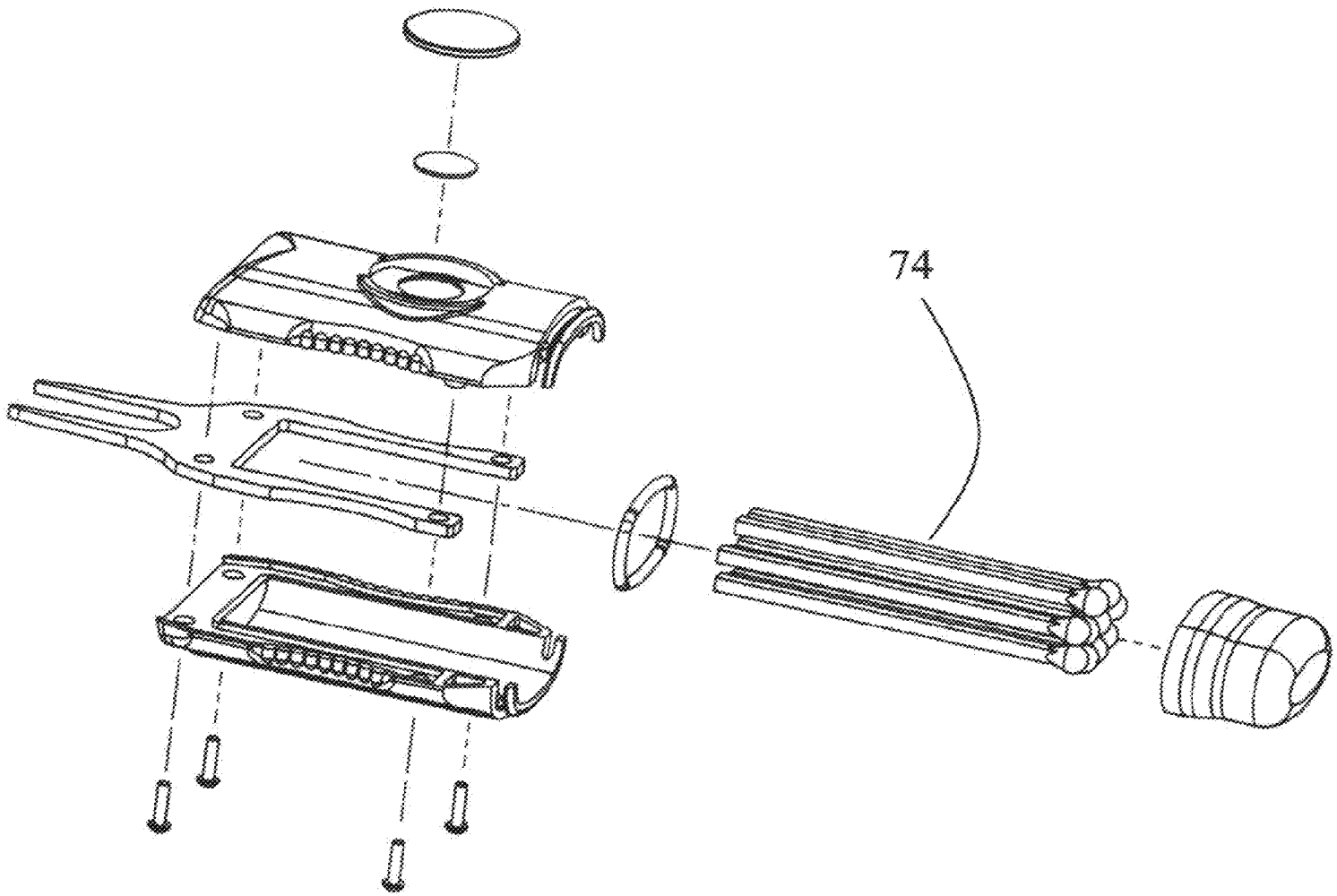
FIG. 3 is an exploded perspective view of the golf divot tool showing a lighting device such as bundle of matches in the tool.

Referring to FIG. 3, there is shown an exploded perspective view of the multi-purpose golf divot tool showing wood matches located inside the tool.

The divot repair tool shown in FIG. 3 is similar in all respects to the divot repair tool shown in FIG. 2 and described in detail above. Therefore, in the interest of brevity, a repetitious recital of the description provided above for the device of FIG. 2, will not be repeated for the divot repair tool of FIG. 3. In addition, for clarity, reference numerals have been omitted for the various parts of the golf divot tool shown in FIG. 3.

FIG. 3 shows the divot repair tool being used to receive a lighting device where said lighting device can be one wood match. In place of the lighting device in the divot repair tool as shown in FIG. 2, a group of matches are inserted into the body of the tool. When the matches are inserted fully into the divot repair tool, the igniter heads of the matches will project beyond the end of the body, and are protected by placing the cap onto the end of the divot repair tool.

Figure 4:
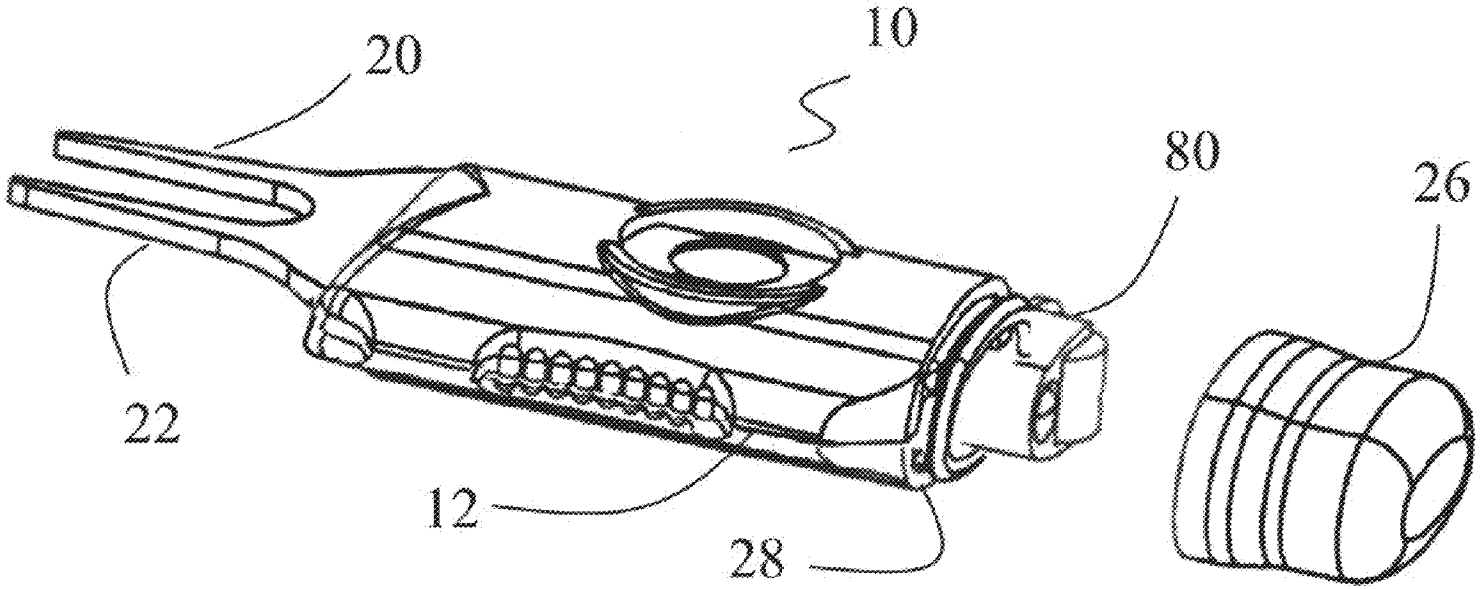
FIG. 4 is a perspective view of the golf divot tool integrated with a lighting.

Referring to FIG. 4, there is shown a perspective view of the golf divot tool integrated with a lighting device 80 such as a lighter integrated in the body 10. In this embodiment, the lighter itself forms the body of the golf divot tool. As shown, the divot tool is comprised of a lighter 80 including an igniting portion at a first end 28; a fuel retaining chamber (not shown) in functional communication with said igniting portion and housed within a handle portion 12; and a two prong divot repair tool 20, 22 integral with said handle. The divot tool can also include a cap 26 that can be used to cover or expose the igniting portion by frictional fit, a snapping closure, a hinge mechanism, or any other similar means.

While there have been shown and described and pointed out the fundamental novel features of the invention as applied to the preferred embodiments, it will be understood that various omissions and substitutions and changes of the form and details of the apparatus illustrated and in the operation may be done by those skilled in the art, without departing from the spirit of the invention.

What is claimed is:

1. A golf divot tool comprising:

a divot tool body;

a unitary member having a two prong divot repair tool protruding from a first end of said divot tool body, two support arms which are disposed to intrude into said body, and a member body connecting said two prong divot repair tool and said two support arms; and a chamber located within said divot tool body and between said two support arms having an entrance at a second end of said divot tool body and a length ending at said second end; wherein said chamber is adapted to receive a lighting device, said two support arms have a length substantially parallel to said chamber length and are retained within said divot tool body.

2. The golf divot tool of claim 1 wherein said lighting device is a lighter.

3. The golf divot tool of claim 1 wherein said lighting device is a replaceable lighter.

4. The golf divot tool of claim 1 wherein said lighting device is a match.

5. The golf divot tool of claim 1 further comprising:

an O ring coupled to the second end of the divot tool body.

6. The golf divot tool of claim 5 further comprising:

a cap removably coupled to the second end of the divot tool body.

7. The golf divot tool of claim 6 wherein a magnet is attached to the divot tool body to hold a ball marker.

8. The golf divot tool of claim 1 wherein said chamber is waterproof.

9. The golf divot tool of claim 1 wherein said divot tool body is made of plastic.

10. The golf divot tool of claim 1 wherein said divot tool body is composed of first and second half members including a U-shaped channel disposed to receive said member body and two support arms therein.

11. A golf divot tool comprising:

a lighter including an igniting portion at a first end and handle portion at a second end, wherein said handle portion of said lighter forms the body of said golf divot tool;

a fuel retaining chamber in functional communication with said igniting portion and housed within said handle portion; and a unitary member having a two prong divot repair tool extending from said lighter at said second end, and two support arms retained by and integral with said handle, wherein said fuel chamber is disposed substantially between said two support arms.

12. The golf divot tool of claim 11 wherein said lighter is a refillable.

13. The golf divot tool of claim 11 further comprising means for covering and exposing said igniting portion.

* * * * *